United States Patent [19]

Steiner et al.

[11] 4,138,020

[45] Feb. 6, 1979

[54] REGENERATION FLOW DISTRIBUTION DEVICE

[75] Inventors: Peter Steiner, Edison; William F. Bischoff, Califon, both of N.J.

[73] Assignee: Foster Wheeler Energy Corporation, Livingston, N.J.

[21] Appl. No.: 796,634

[22] Filed: May 13, 1977

[51] Int. Cl.[2] ..... B65G 65/40

[52] U.S. Cl. ..... 214/17 C; 55/463; 210/269; 222/564

[58] Field of Search ..... 23/270 R, 288 B, 288 G; 55/390, 463; 210/33, 189, 268, 269, 285, 286, 152; 222/459, 547, 564; 209/254; 214/17 R, 17 A, 17 C

[56] References Cited

U.S. PATENT DOCUMENTS

| | | | |
|---|---|---|---|
| 1,686,077 | 10/1928 | Evans | 222/459 |
| 2,881,134 | 4/1959 | Findlay | 23/288 G |

FOREIGN PATENT DOCUMENTS

| | | | |
|---|---|---|---|
| 2510366 | 11/1975 | Fed. Rep. of Germany | 210/33 |

*Primary Examiner*—Frank A. Spear, Jr.
*Assistant Examiner*—Ivars Cintins
*Attorney, Agent, or Firm*—Marvin A. Naigur; John E. Wilson; Warren B. Kice

[57] ABSTRACT

A device for controlling the flow distribution through a regeneration vessel of a mixture of a carbonaceous adsorbent material and an inert material in an adsorbent material regeneration process in which a lower, conical section is supported by a hopper portion of the vessel, and an upper, conical section extends within the vessel. A plurality of angularly spaced flow passages extend longitudinally through the device, from the upper surface of the upper section to an interior chamber of the device disposed within the hopper, which is in fluid communication with the discharge of the vessel. The longitudinal axis of each passage is inclined at an angle of between 55°-90° relative to a base plane of the device, with 70° being a preferred value.

16 Claims, 3 Drawing Figures

REGENERATION FLOW DISTRIBUTION DEVICE

BACKGROUND OF THE INVENTION

This invention relates to the regeneration of carbonaceous adsorbent material, and more particularly, to a device for controlling the flow distribution of the adsorbent material through the regeneration vessel during the regeneration process.

In the field of atmospheric pollution control, it is known to use an adsorptive process for the desulfurization of flue gas. The principal underlying the process is the adsorption of sulfur dioxide ($SO_2$) on carbonaceous adsorbent material and its conversion to sulfuric acid by combining with the oxygen and water vapor also present in the flue gas. The sulfuric acid is enriched adsorbatively in the porous system of the carbonaceous adsorbent, which is a material called "char" and is commonly in pellet form. The char pellets loaded with sulfuric acid are regenerated by a process in which the acid is decomposed to sulfur dioxide, carbon dioxide and water, with some consumption of the char. The sulfur dioxide-enriched gas is further processed as desired.

The regeneration of the saturated char can be accomplished by washing (wet regeneration) or by contacting it with hot sand (thermal regeneration). Wet regeneration produces dilute sulfuric acid (18% by weight) as a by-product, and because of the limited use for this by-product, thermal regeneration is the more practical method.

In thermal regeneration, an enclosed, refractory-lined vessel is utilized to contact the saturated char pellets with hot sand, which has been heated to approximately 815° C.(1500° F). As the char pellets become heated, the reactions that occurred during the adsorption process are reversed, producing a concentrated stream of sulfur dioxide, water, carbon dioxide, and nitrogen. During regeneration, the hydrogen sulfate produced in the adsorption process is converted to water and sulfur trioxide which, in turn, is reduced to sulfur dioxide in the presence of the hot char and produces carbon dioxide by the combination of the liberated oxygen with the carbon in the char. In a like manner, the oxides of nitrogen are reduced to nitrogen, with the resultant production of additional carbon dioxide.

Sand is utilized as an inert, heat-transfer media in thermal regeneration and, as such, does not take part in the reactions occurring within the regenerator. Its sole function is to supply heat so that the reactions may take place. Regeneration is accomplished with the mixture of sand and char having a temperature in the range of 500°-600° C.(932°-1202° F). The mixture of hot sand and char flows slowly down through the regeneration vessel, with the flow being controlled by a char-sand separator/feeder positioned below the discharge hopper of the vessel.

With thermal regeneration, a regeneration temperature with a high, heating velocity can be achieved. This results in a regeneration vessel of small volume and a short char residence time, or the time that the char is physically within the generator reactor as it flows therethrough. In addition, side reactions, e.g., with oxygen, which would consume additional char, can be eliminated.

To ensure proper and efficient regeneration it is necessary to ensure the uniform and continuous flow of the char-sand mixture through the vessel, with a minimum residence time therein. In the prior art, one means of controlling this flow through the vessel consisted of a single, cone structure, which was formed with a base having an outside diameter less than the inside diameter of the hopper portion of the vessel in which the flow control cone was mounted. In this manner, an annular passageway was created between the base of the cone and the inside diameter of the hopper. However, this prior art flow control cone had several disadvantages from a structural standpoint. For example, it was particularly difficult to mount the flow control cone in the reactor. The cone was generally secured to the hopper by a plurality of angle-iron support members, each of which was attached at one end to the circumference of the cone and at the other end to the inner surface of the hopper. These supporting members, of course, obstructed the flow path and, consequently, the flow passages were frequently plugged, causing clogging of the flow and making flow distribution difficult.

SUMMARY OF THE INVENTION

Accordingly, it is an object of the present invention to provide an improved flow distribution means to regulate the flow characteristics and produce uniform mass flow of a char-sand mixture through a regeneration vessel.

Another object of the present invention is to provide an improved flow distribution means for a regeneration vessel which will provide uniformity of the residence time of the char-sand mixture in the vessel.

A further object of the present invention is to provide an improved flow distribution means for a regeneration vessel which will prevent plugging of the flow passages.

Yet another object of the present invention is to provide an improved flow distribution means for a regeneration vessel which is easily installed and stably supported within the vessel.

Toward the fulfillment of these and other objects, the flow distribution device of the present invention comprises an element of abrasion-resistant, refractory material having a cone configuration which resembles two conical sections joined at their base surfaces. The bottom, conical section conforms to the conical shape of the hopper portion of the regeneration vessel to provide stable support for the device, and the upper conical section extends upwardly into the vessel. A plurality of holes extend through the element, with each of the holes oriented at approximately 70° relative to a horizontal plane through the upper section of the element, to provide flow passages which regulate the distribution of the char-sand mixture as it flows through the hopper portion. Since the holes are located in a substantially parallel relationship to the center line of the regeneration reactor, plugging of these passages by the mixture is avoided.

BRIEF DESCRIPTION OF THE DRAWINGS

The above description, as well as further objects, features, and advantages of the present invention, will be more fully appreciated by reference to the following description of a presently-preferred but nonetheless illustrative embodiment in accordance with the present invention, when taken in connection with the accompanying drawings, wherein.

DESCRIPTION OF THE PREFERRED EMBODIMENT

Figure 1:
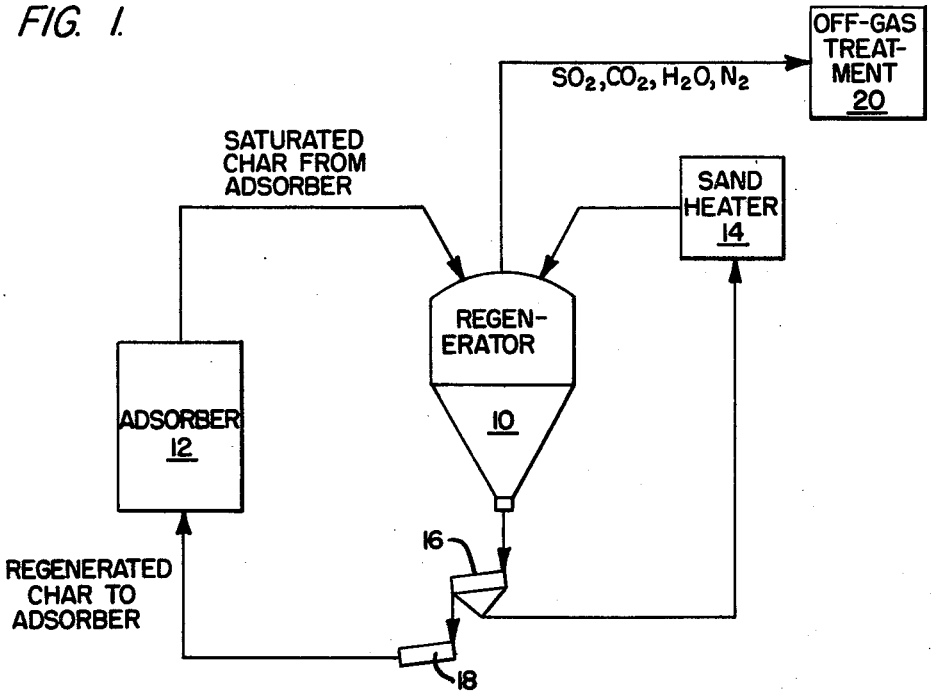
FIG. 1 is a schematic view, showing the flow of material to the regeneration vessel of an adsorption system used for the desulfurization of flue gas.

Referring more particularly to FIG. 1, a regeneration vessel, designated generally by the reference character 10, is supplied with char from an adsorber 12 and heated sand from a sand heater 14. The char is saturated with sulfuric acid, nitrous oxide, and particulate matter adsorbed during its flow through the adsorber 12. A char-sand feeder/separator 16 is disposed below the regeneration vessel 10 to receive the discharged mixture of char and sand. The separated char is supplied to a char cooler 18, wherein the hot char pellets are cooled by any known, conventional method, and is then subsequently returned to the adsorber 12 for reuse. The sand passes through the char-sand feeder/separator 16 and is returned to the sand heater 14 via known means. The by-products from the regeneration of the saturated char are passed to an off-gas treatment facility 20.

Figure 2:
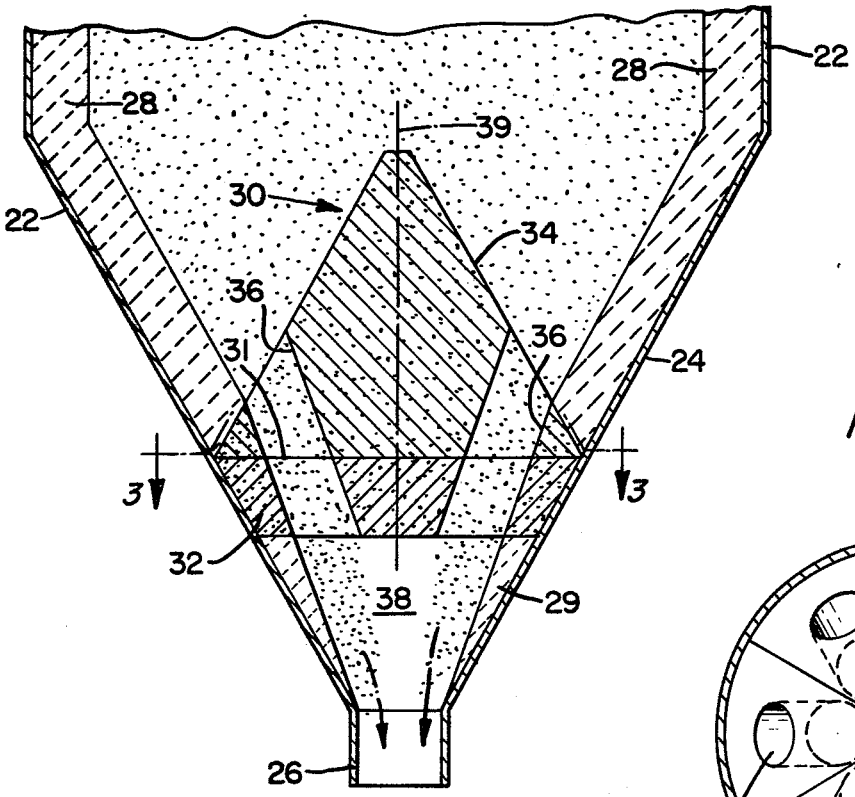
FIG. 2 is a cross-sectional view of the lower portion of the regeneration vessel shown in FIG. 1, showing the flow distribution cone of the present invention.
Figure 3:
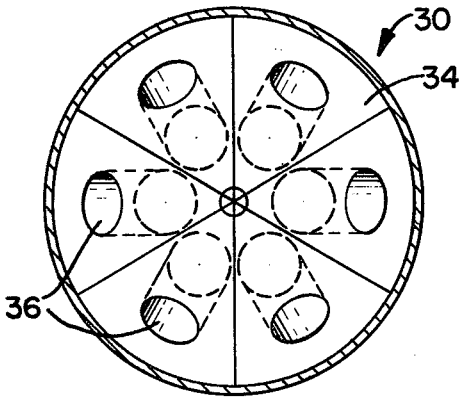
FIG. 3 is a cross-sectional view taken along line 3—3 of FIG. 2.

With reference to FIGS. 2 and 3, the lower portion of the regeneration vessel 10 is formed into an upper, cylindrical section 22 and an inverted, conically-shaped hopper section 24 for the discharge of the char-sand mixture into a discharge chute 26 extending below the hopper section. The inner surface of the cylindrical section 22 is provided with a thermal-insulating layer 28 of refractory material, and a conical, hollow plug 29 of refractory material is disposed within the lower end portion of the hopper section 24.

A flow distribution cone 30 is supported by the lower, inner conical surface of the hopper section 24 and the plug 29, and operates to regulate the uniformity of the flow of the char-sand mixture into the discharge chute 26. As shown in FIG. 2, the configuration of the flow distribution cone 30 comprises a bio-conically shaped element having two, separate, truncated cones 32 and 34, which are joined together at their base surfaces, denoted by the line 31, with the outer surface of the lower, conical section 32 shaped to conform to the inner, conical surface of the hopper section 24 and the upper, conical section 34 extending upwardly into the interior volume of the regeneration vessel 10. A plurality of circular holes 36, for example six holes as shown, extend longitudinally through the flow distribution cone 30, with the lower opening of each hole in fluid communication with a flow chamber 38 formed in the interior of the refractory plug 29. As shown in FIG. 2, the entrance opening of each hole is located on the conical surface of revolution of the upper cone 34. The flow chamber 38, in turn, is in fluid communication with the discharge chute 26 of the hopper section 24.

The central, longitudinal axis of each of the holes 36 is disposed at an angle relative to the line 31. The angle of the axis of each of the holes 36 is established by the generally 45° angle of repose formed by a pile of the char-sand mixture disposed on a flat surface above the plug 29, assuming that there is not a discharge chute 26. In other words, a pile of the char-sand mixture would resemble a cone having a 45° surface angle relative to its base, and to ensure the free and even flow of the mixture through the flow distribution cone 30, the minimum angle at which the axis of each of the holes 36 may be oriented relative to the base surface of the distribution cone would be somewhat greater than 45°, such as 55°. A smaller angular orientation, i.e., less than 45°, may lead to clogging of the holes, and an angular orientation approaching 90°, would produce straight-through flow, without any distribution of the mixture. Thus, the angular orientation of the holes 36 may be within the range of 55°–90°, with the preferred angle being approximately 70°.

The number, size and angular orientation of the holes 36 in the flow distribution cone 30 are related to the internal diameter of the cylindrical section 22. In the illustrative embodiment of the flow distribution cone 30 shown in FIGS. 2 and 3, the internal diameter of the cylindrical section 22 is approximately 8 feet, and each of the six holes 36 is approximately 8 inches in diameter and is disposed at an angular orientation of approximately 70°. Accordingly, if the diameter of the cylindrical section 22 is increased, then additional holes 36 would be provided in the flow distribution cone 30, or the size of each hole increased, or both techniques utilized. Additionally, the angular orientation of each of the holes 36 would be increased proportionately within the 70°–90° range. Conversely, the same considerations apply if the diameter of the cylindrical section 22 is reduced. By directly proportioning the number, size and angular orientation of the holes 36 relative to the size of the regeneration vessel 10, the desirable and necessary even flow distribution of the char-sand mixture through the vessel can be achieved.

The flow distribution cone 30 may be made, preferably, from an abrasion-resistant refractory material to withstand the abrasion of the char-sand mixture at the temperatures of between 600° C.-800° C. (1200° F. - 1500° F.) customarily encountered within the regenerator 10. Alternatively, the cone 30 may be made of a metallic core covered with a layer of an abrasion-resistant material. The cone 30 may be fabricated as a single, monolithic structure, with the holes 36 integrally formed during the fabrication process. Alternatively, the cone 30 may be fabricated from six equal sections, which are subsequently joined to form the cone, as shown by the lines in FIG. 3. Similarly, the cone 30 may be fabricated in two, separate, longitudinal sections corresponding to sections 34 and 36 to reduce the expense involved in the fabrication thereof.

In operation, the saturated char from the adsorber 12 and the heated sand from the sand heater 14 are introduced into the upper portion of the regenerator 10 in a controlled manner via any suitable flow control means. The saturated char is directly mixed with the hot sand at a temperature of between 650° and 728° C.(1200° F. to 1328° F.), which results in a temperature of the mixture of 500°–600° C. (932°–1202° F.), depending upon the temperature of the incoming sand. The mixture of hot char pellets and hot sand flows slowly, downwardly through the regeneration vessel 10 in 10 or 20 minutes. The flow of the mixture through the holes 36 in the flow distribution cone 30 provides for an even distribution of the mixture through the hopper section 24, with the mixture flowing at a uniform velocity. The mixture passes downwardly through each of the holes 36 and into the flow chamber 38. The flow rate of the mixture from the chamber 38 is controlled, in turn, by the char-sand feeder/separator 16, which also acts to separate these two materials after regeneration. The char pellets, being considerably larger than the sand, flow overhead in the feeder/separator 16 and into the char cooler 18, to be cooled and returned to the adsorber 12 for reuse.

The separated sand passes through the char-sand feeder/separator 16 to the sand heater 14, which restores the heat lost to the char and recycles the reheated sand to the top of the regenerator 10 to complete the cycle. The heat required to restore the sand to its proper temperature in the sand heater 14 may be provided by combustion gases from a furnace, (not shown), which also acts to pneumatically convey the sand to the top of the regenerator 10, or may be provided by a fluidized-bed heat source (not shown), as is known in the art.

The by-products of the char regeneration process, or the so-called "off-gas", is obtained in an undiluted condition and has, thus, the highest possible concentration. Therefore, the sulfur dioxide in the flue gas, which is in low concentrations (0.05% to 0.3% by volume), can be concentrated up to more than 30% by volume. This sulfur dioxide-rich gas can then be further processed in the off-gas treatment facility 20 into liquified sulfur dioxide, sulfuric acid, or elemental sulfur. The methods utilized in the treatment facility 20 may be any known in the art.

Although not particularly illustrated in the drawings, it is understood that all of the components described above are arranged and supported in an appropriate fashion to form a complete and operative system. Further, it is understood that all of the components in the overall system have not been specifically described, but that such components are known and would be appropriately incorporated into the operative system.

In the context of the present discussion, the terms "flow control" and "flow distribution" have specific meanings. "Flow control" refers to the rate of quantity flow through the regeneration vessel, which in turn is determined by the rate of quantity input of the char and sand into the vessel, and the rate of quantity removed from the vessel via the char-sand feeder/separator disposed at the outlet of the vessel. "Flow distribution" relates to the flow characteristic, i.e., the uniformity, of the flow of the char-sand mixture in the vessel. A flow distribution device evens out the flow velocities of the mixture and minimizes the difference in residence time between char pellets. Since the regeneration process is principally a chemical process, uniformity of flow of the mixture ensures complete regeneration of all of the char pellets.

Of course, variations of the specific construction and arrangement of the regenerator and the flow distribution cone disclosed above, can be made by those skilled in the art without departing from the invention as defined in the appended claims.

We claim:

1. A flow distribution device for controlling the uniform distribution of a particulate material flowing from a container, comprising:

a bi- conically-shaped element having upper and lower conical surface portions, said surface portions being conical surfaces of revolution about a longitudinal axis of said element and having their respective base portions meeting at a plane orthogonal to the longitudinal axis of said element, said lower conical portion truncated by a plane parallel to said first-mentioned plane; and a plurality of through passages extending substantially longitudinally of said element, each of said passages being disposed at a predetermined angle greater than 45° and less than 90° relative to said first-mentioned plane, each of said passages having an entrance opening on said upper conical surface and a exit opening on said truncated surface.

2. The flow distribution device of claim 1, wherein the angle of each of said passages is within the range of 55° to 90°.

3. The flow distribution device of claim 1, wherein the angle of each of said passages is 70°.

4. The flow distribution device of claim 1, further comprising a surface layer of abrasion-resistant material on said element.

5. The flow distribution device of claim 1, wherein said elements comprises a plurality of longitudinal segments, each segment having a through passage extending therethrough.

6. The flow distribution device of claim 1, wherein said passages are angularly spaced about said longitudinal axis.

7. In combination with a regeneration vessel for the thermal regeneration of an adsorbent material, means for introducing into the vessel a saturated adsorbent material from an adsorption source, means for introducing into the vessel a heated, inert material from a second source, and a discharge means disposed adjacent the exit portion of said vessel, a flow distribution device for controlling the uniform distribution of the flow of the mixture of said adsorbent material and said inert material from said discharge means, said device comprising:

a bi- conically-shaped element having upper and lower conical surface portions, said surface portions being conical surfaces of revolution about a longitudinal axis of said element and having their respective base portions meeting at a plane orthogonal to the longitudinal axis of said element, said lower conical portion truncated by a plane parallel to said first-mentioned plane; and a plurality of through passages extending substantially longitudinally of said element, each of said passages being disposed at a predetermined angle greater than 45° and less than 90° relative to said first-mentioned plane, each of said passages having an entrance opening on said upper conical surface and an exit opening on said truncated surface.

8. The combination of claim 7, wherein said discharge means includes a hopper, and said lower, truncated conical portion of said element is disposed in abutting contact with the inner surface of said hopper.

9. The combination of claim 8, wherein the angle of each of said passages is within the range of 55° to 90°.

10. The combination of claim 8, wherein the angle of each of said passages is 70°.

11. The combination of claim 8, further comprising a surface layer of abrasion-resistant material on said element.

12. The combination of claim 8, wherein said element comprises a plurality of equal, longitudinal segments, each segment having a through passage extending therethrough.

13. The combination of claim 8, further including means to receive and remove the mixture of materials from said hopper.

14. The combination of claim 7, wherein said passages are angularly spaced about said longitudinal axis.

15. The flow distribution device of claim 1, wherein said lower truncated conical portion is provided with a chamber opening to the exterior of said device, and said through passages are in communication with said chamber.

16. The combination of claim 7, wherein said lower truncated conical portion is provided with a chamber opening to said discharge means, and said through passages are in communication with said chamber.

* * * * *